US007658185B2

(12) United States Patent
Perry

(10) Patent No.: US 7,658,185 B2
(45) Date of Patent: Feb. 9, 2010

(54) CHAMBER FOR WEAPON

(75) Inventor: Anthony Perry, 314 E Nugent Ave., Temple, TX (US) 76501

(73) Assignee: Anthony Perry, Gilbert, AZ (US)

( * ) Notice: Subject to any disclaimer, the term of this patent is extended or adjusted under 35 U.S.C. 154(b) by 483 days.

(21) Appl. No.: 11/353,379

(22) Filed: Feb. 13, 2006

(65) Prior Publication Data

US 2007/0186761 A1 Aug. 16, 2007

(51) Int. Cl.
*F41B 11/00* (2006.01)

(52) U.S. Cl. ..... 124/72; 89/7

(58) Field of Classification Search ..... 124/71–77; 89/7

See application file for complete search history.

(56) References Cited

U.S. PATENT DOCUMENTS 2,601,555 A * 6/1952 Pope ..... 124/65
2,630,108 A * 3/1953 White ..... 124/65
2,653,593 A * 9/1953 Foster ..... 124/65
2,725,868 A * 12/1955 Foster ..... 124/65
2,725,869 A * 12/1955 Barber ..... 124/66
2,729,207 A * 1/1956 Foster ..... 124/65
2,749,902 A * 6/1956 Foster ..... 124/65
2,762,356 A * 9/1956 Foster ..... 124/65
3,765,396 A * 10/1973 Kienholz et al. ..... 124/65
3,938,272 A * 2/1976 Ditto et al. ..... 42/55
5,058,561 A * 10/1991 Starr ..... 124/65
5,343,849 A * 9/1994 Steer ..... 124/72
6,067,975 A * 5/2000 Ginn ..... 124/59
6,644,294 B2 * 11/2003 Christensen ..... 124/77
2003/0047105 A1 * 3/2003 Vasel et al. ..... 102/502
2006/0011090 A1 * 1/2006 Vasel et al. ..... 102/512
2006/0027223 A1 * 2/2006 Vasel et al. ..... 124/57
2008/0017179 A1 * 1/2008 Vasel et al. ..... 124/56

* cited by examiner

*Primary Examiner*—Troy Chambers

(57) ABSTRACT

A barrel assembly for a device for shooting projectiles is disclosed. The barrel assembly comprises a firing chamber with first and second openings, wherein the firing chamber is capable of holding at least two projectiles. A first projectile retention device is located at the second opening of the firing chamber. A propellant injection device injects propellant into the firing chamber through a third opening. A firing control device initiates the injection of propellant into the firing chamber, wherein at least one projectile and the projectile retention device substantially seal the second opening of the firing chamber when propellant is introduced and at least one projectile is expelled out of a barrel through the first opening of the firing chamber.

26 Claims, 5 Drawing Sheets

CHAMBER FOR WEAPON

FIELD OF THE INVENTION

This invention pertains in general to the field of barrel assemblies for weapons and firearms. More particularly, the invention relates to a barrel assembly which uses a projectile and a projectile retention device to substantially seal one opening in the barrel assembly during the firing operation.

BACKGROUND OF THE INVENTION

The use of pneumatic guns, for example, paintball guns, has grown substantially over the past 20 years. Typical pneumatic and pneumatic paintball guns control and direct the expansion of compressed gas to accelerate a projectile through a cylindrical barrel. Paintball weapons accelerate a projectile that strikes and deposits paint on a target. The weapons are used to mark an opposing combatant to simulate being shot without substantial harm to the combatant. This simulation is useful to train police, military personnel and for recreational, competitive games and simulation. In such simulations and games, weapons that can fire at a high rate of fire while retaining accuracy increase the successful marking of other opposing combatants and more accurately simulate conventional firearms.

These types of weapons are not limited to paintball or BB guns. These weapons can also be used to inflict lethal or non-lethal force through the use of conventional or rubber bullets, beanbags, and projectiles filled with irritants, pungent chemical or other disorienting means. Furthermore, the guns can be used to deliver prizes (tee shirts, baseballs, etc.) at sporting events.

One problem with known pneumatic guns is that they use a mechanical piston or bolt to seal the firing chamber after a projectile has been loaded into the firing chamber. This mechanical piston or bolt may damage the projectiles before they are even fired. FIG. 1 shows a portion of a typical barrel assembly for a pneumatic gun. The barrel 10 has a firing chamber 12 from which a projectile 22 is fired out of the barrel 10 through the opening 14. A piston or bolt 16 is used to load projectiles into the firing chamber and to block a second opening 18 in the firing chamber 12. In operation, when the firing sequence is initiated, propellant such as air or a gas is introduced into the firing chamber 12 through an inlet valve 20. The pressure expansion caused by the propellant causes the projectile 22 to overcome the projectile restraint 24 and be expelled through the opening 14. To reload, the piston or bolt 16 is retracted and another projectile from the hopper 24 is moved into the firing chamber as the piston or bolt 14 is moved back to seal the second opening 18.

The physical movement of the piston or bolt 16 causes various problems. First of all, the piston or bolt 16 may rub against the projectiles as it opens and closes and introduce defects into the projectile. The defects may change the flight characteristics of the projectile which can affect the accuracy of the gun. Furthermore, a partially chambered projectile may become jammed when the piston or bolt 16 is moved to seal the opening 14. This may even lead to the rupture of the projectile inside the gun. In addition, the piston or bolt 16 may become jammed due to a mechanical failure thereby rendering the gun inoperable.

Thus, there is a need for a new barrel assembly which overcomes the problems described above with known barrel assemblies.

Hence, an improved barrel assembly which reduces the problems associated with loading projectiles using a mechanical piston or bolt would be advantageous.

Some of these problems are alleviated in guns with multiple projectiles in a single chamber, but then have further problems associated with reloading. This type of gun is comprised of a stack of alternating projectiles and powder. The projectiles radially expand to seal the explosion from disturbing the next charge. Each round is in a different part of the barrel stack and has a different effective barrel length which decreases consistency and accuracy. Also, the breach end of the barrel is permanently sealed. This forces the user to reload the weapon through the muzzle or the barrels may be disposable or must be reloaded back at the factory. This is very inconvenient and makes sustained automatic fire difficult to achieve.

SUMMARY OF THE INVENTION

Accordingly, the present invention preferably seeks to mitigate, alleviate or eliminate one or more of the above-identified deficiencies in the art and disadvantages singly or in any combination and solves at least the above mentioned problems by providing a barrel assembly and a method for shooting projectiles according to the appended patent claims.

One objective of the present invention is to provide a chamber assembly for projectile acceleration systems that permits rapid loading, and discharge of projectiles.

In particular, an objective of the present invention is to provide a chamber assembly in which multiple projectiles are loaded into a chamber wherein one or more loaded projectiles contribute to sealing of the chamber to prevent propellent force from escaping and instead to be applied to one of the projectiles to accelerate and expel the projectile from said chamber.

It is a further objective of the present invention to provide a chamber assembly which allows loading of the chamber with multiple projectiles through an opening other than the muzzle.

It is a further object of the present invention to permit radial flexing of the chamber wall to decrease the inner diameter of the chamber to retain one or more loaded projectiles and contribute to sealing said chamber.

It is a further object of the present invention to partially or completely seal one opening of said chamber with a projectile to be expelled in a later firing cycle.

An additional object of the invention is to allow for a plurality of chamber assemblies to be assembled in an array with respective loading reloading assemblies and cylindrical barrels to accuracy direct expelled projectiles. The present invention alleviates disadvantages of prior art as the inherent chamber simplicity, separate propellent, and breach loading permits high unit density and reload ability.

According to another aspect of the invention, a barrel assembly is provided for a device for shooting projectiles, comprising:

a firing chamber with first and second openings; said firing chamber being capable of holding at least two projectiles a first projectile retention device at said second opening of the firing chamber a propellant injection device for injecting propellant into the firing chamber through a third opening, a firing control device for initiating the injection of propellant into the firing chamber, wherein at least one projectile and said projectile retention device substantially seal the second opening of the firing chamber when propellant is introduced and at least one projectile is expelled out of a barrel through the first opening of the firing chamber.

According to one aspect of the invention, a method is provided for firing and loading a device for shooting projectiles, said device having a firing chamber with first and second openings comprising the steps in any sequence of:

substantially sealing the second opening of the firing chamber using at least one projectile in the firing chamber and a projectile retention device;

introducing propellant into the firing chamber wherein at least one projectile is expelled through the first opening;

relaxing the projectile retention device to allow for additional projectiles to be loaded into the firing chamber.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DESCRIPTION OF EMBODIMENTS

The following description focuses on an embodiment of the present invention applicable to a weapon and in particular to a gun. However, it will be appreciated that the invention is not limited to this application but may be applied to any projectile acceleration device, including but not limited to weapons, weapon arrays, firearms, pneumatic guns, BB guns, paintball guns etc.

Figure 1:
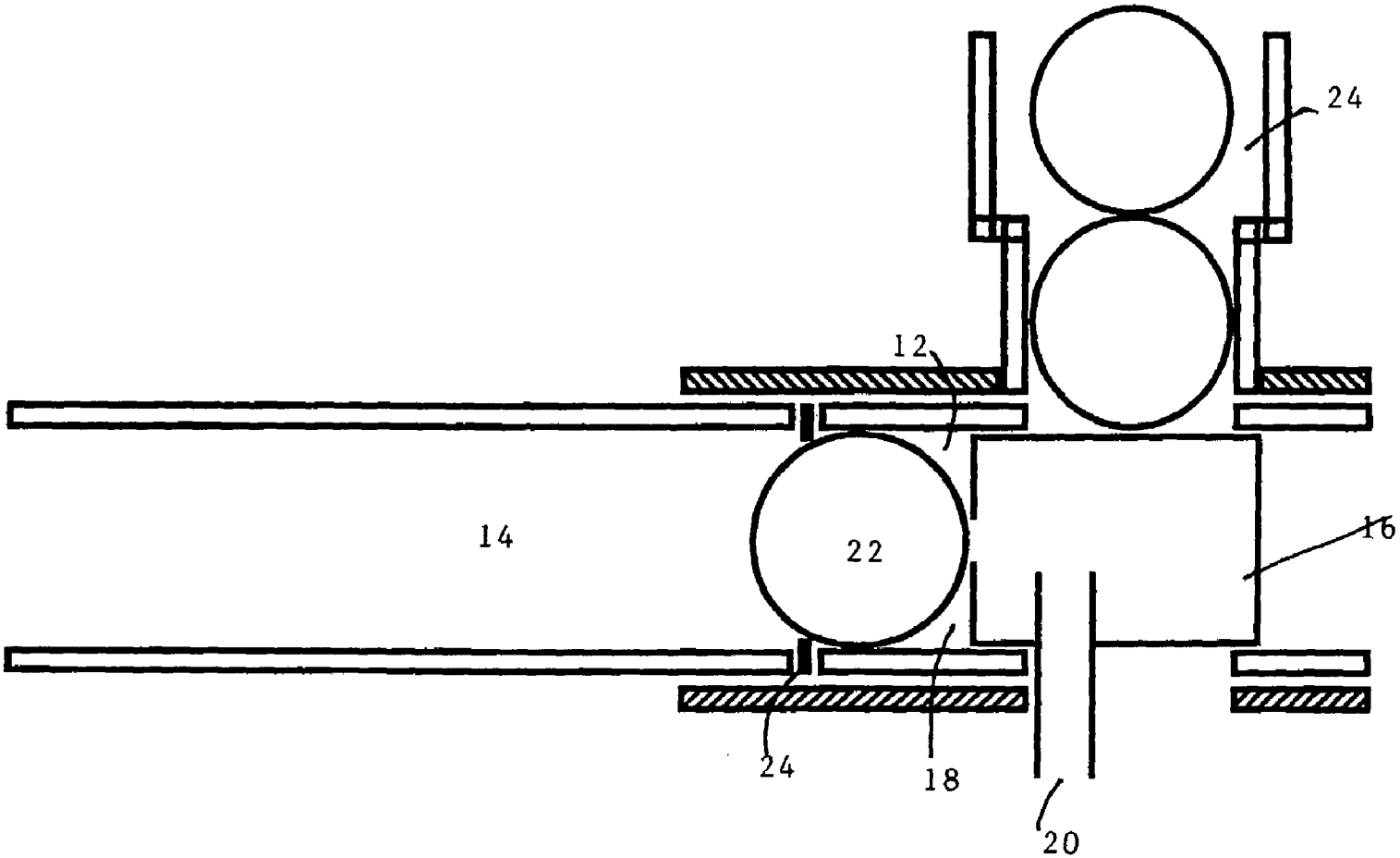
Fig. 1 Prior Art
FIG. 1 illustrates a known barrel assembly.
Figure 2:
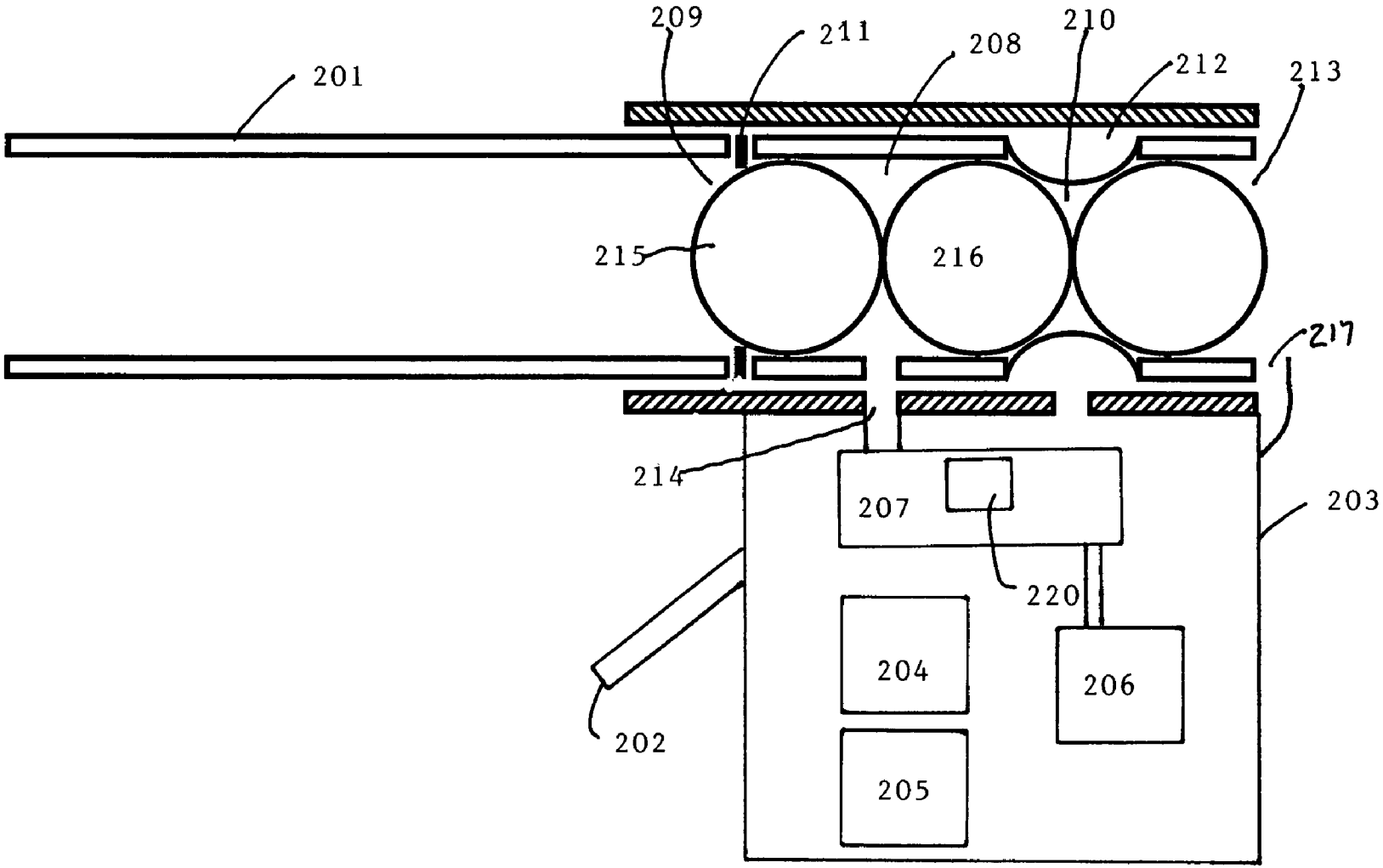
FIG. 2 illustrates a barrel assembly according to one embodiment of the invention.

FIG. 2 illustrates a gun 200 using a barrel assembly 201 according to one embodiment of the invention. In addition to the barrel assembly 201, the gun also comprises, among other features, a trigger system 202, a handle 203, an electronic control circuit 204, a battery 205, a supply of propellant 206 and a propellant injection device 207. The trigger system 202 may be any type of mechanical or electrical trigger and the invention is not limited thereto. The supply of propellant is connected to the propellant injection device 207. The supply of propellant may be in a compressed gas cylinder normally containing $CO_2$, $NO_2$, or air, although other gases may also be used. In addition ignitable propellants can also be used. The propellant injection device 207, for example, but not limited to, an air solenoid valve, a spring piston sear valve, a solenoid/sear valve combination or a propellant injector with an ignition spark device, is controlled by the control circuit 204.

Briefly, in the spring piston sear valve design, dual pistons are stacked on top of each other in two barrels with a interconnecting slot. The pistons are physically linked by a pin in that slot. As the two pistons are trigger released, they spring forward. The top piston chambers a projectile that is gravity fed from an opening on the side. The bottom piston slams into a spring sear valve opening it for a brief moment. This allows a bolus of air to escape which expels the projectile and pushes both pistons back to the firing position. Also, a solenoid valve/sear combination is often used. The solenoid valve air moves the pistons and the sear bolus accelerates the projectile.

The control circuit 204 also controls how much propellant the propellant injection device 207 injects into the firing chamber so as to vary the force at which the projectile is expelled from the firing chamber. The user of the gun may vary the amount of propellant by, for example, turning a dial on the handle 203 or by inputting the command into the control circuit 204.

The barrel assembly 201 comprises, among other features, a firing chamber 208 with a first opening 209 and a second opening 210, a projectile retention device 211, a projectile retention device 212, a storage chamber 213 and a propellant inlet 214 as will be explained in more detail below.

Figure 3:
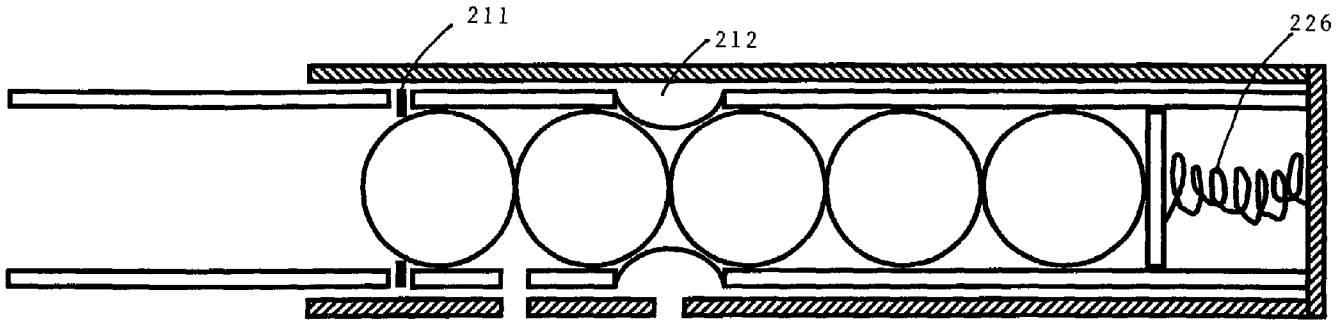
FIG. 3 illustrates a barrel assembly according to one embodiment of the invention.

The operation of the barrel assembly will now be described with reference to FIGS. 3(*a*)-3(*d*). FIG. 3(*a*) illustrates the firing chamber 208 being loaded with two projectiles 215, 216. It will be understood by those skilled in the art that any number of projectiles can be loaded into the firing chamber 208. The size of the firing chamber 208 can vary and the position of the first and second projectile retention devices 211, 212 can also vary to accommodate the desired number of projectiles in the firing chamber 208. In addition, any number of projectiles in the firing chamber can be fired at the same time except for the last projectile in the firing chamber for the reasons described below.

Figure 4:
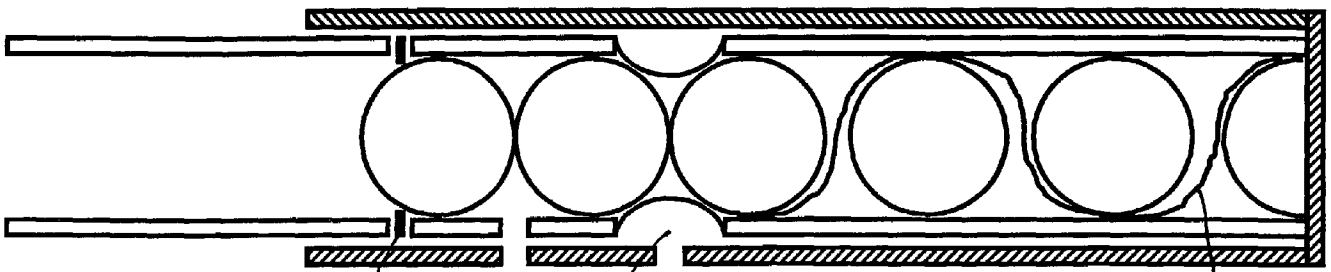
FIG. 4 illustrates a barrel assembly according to one embodiment of the invention.
Figure 5:
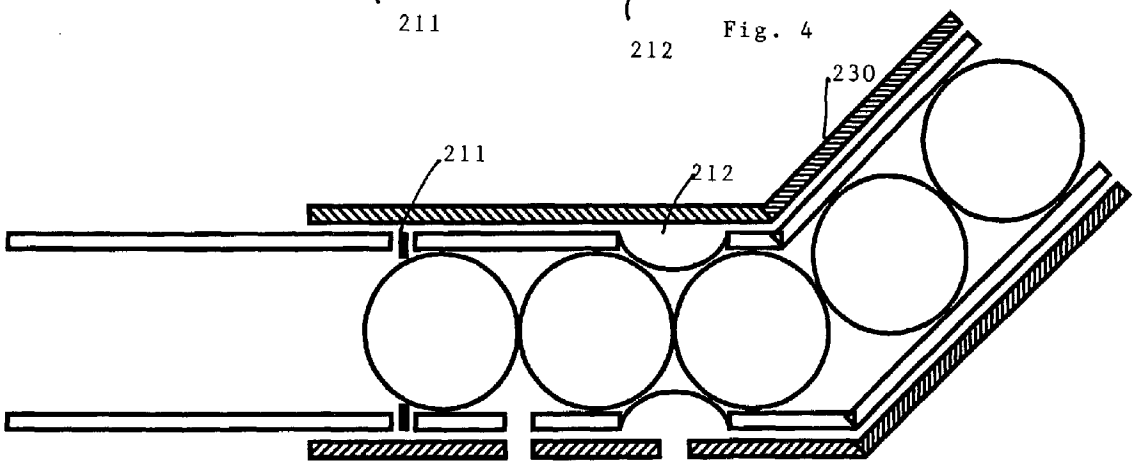
FIG. 5 illustrates a barrel assembly according to one embodiment of the invention.

The projectiles are first loaded into a storage magazine 213 through a breech. The projectiles are physically biased towards the firing chamber 208 by either gravity and/or mechanical pressure created by axial or rotational spring tension, but the invention is not limited thereto. As illustrated in FIG. 3, the projectiles are loaded into a cylinder magazine which has a spring 226 at the end opposite the opening to the firing chamber which biases the projectiles toward the firing chamber. Alternatively, the projectiles may be held in a helical support 228 as illustrated in FIG. 4. As the spiral twists under spring tension, the helical support 228 rotates feeding the projectiles forward toward the firing chamber. In addition, the projectiles may be baised towards the firing chamber 208 by gravity as illustrated in FIG. 5. In this embodiment, the projectiles are stored in a magazine or hopper which is located above the gun barrel. The projectiles are pulled by gravity down the sloping feed tube 230 as each projectile is moved into the firing chamber. As mentioned above, the design of the storage magazine and the manner in which the projectiles are biased toward the firing chamber is not limited to the illustrative examples described above.

The projectiles are pushed into the firing chamber 208 until the front projectile rests against the projectile retention device 211. The projectile retention device 211 may have various forms and the invention is not limited to the following examples. One or more spring loaded or biased pins or flexible pieces of plastic/rubber/metal, for example flanges, may protrude into the bore of the barrel to prevent the front projectile 215 from passing through the first opening 209 of the firing chamber 208 until the gun is fired. Alternatively, a flexible membrane like a rubber washer with a diameter slightly less than the diameter of the bore may be used as the projectile retention device 211. The flexible membrane can have any type of surface such as smooth, ribbed, etc. While the projectile retention device 211 may have many forms, the retention device must be both resistant to the magazine pressure while compliant to the pressure caused by the injection/ignition of the propellant.

Figures 6A, 6B, 6C, 6D:
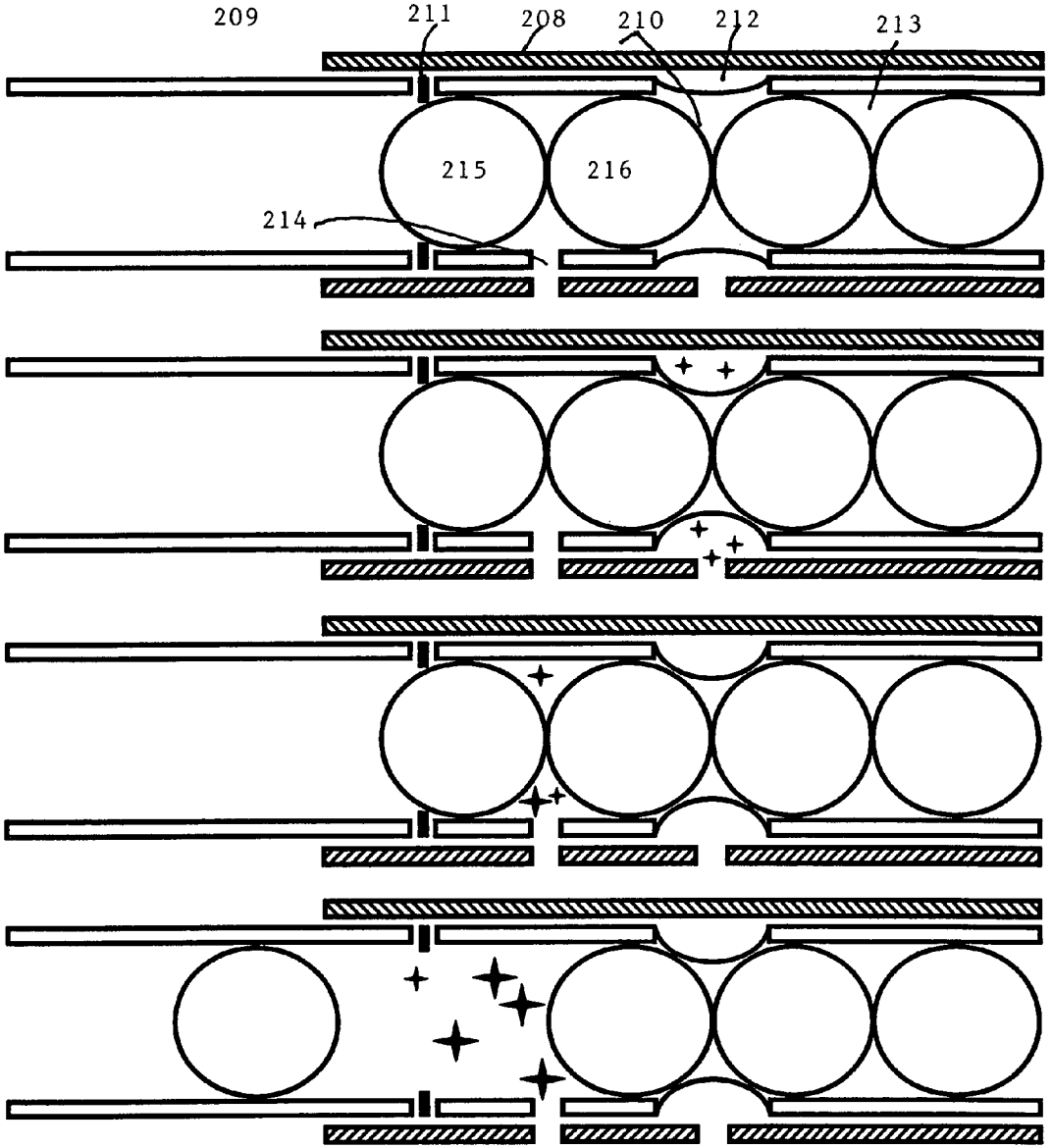
FIGS. 6(*a*)-6(*d*) illustrate a firing sequence according to one embodiment of the invention.

While the firing chamber is being loaded, the projectile retention device 212, according to one embodiment of the invention, is in a deflated/dilated condition to allow the projectiles in the storage magazine to be loaded into the firing chamber. According to one embodiment of the invention, the retention device 212 is comprised of a flexible membrane that is either attached radially in the bore of the barrel at the second opening 210 of the firing chamber 208 or is a part of the barrel wall at the second opening 210 of the firing chamber 208, e.g. where at least a section of the barrel in the firing chamber is flexible and can act as the retention device. The retention device 212 may have many forms, for example a flexible or inflatable membrane, one or more flanges, etc., and the invention is not limited to the described examples. In a first embodiment of the invention, the retention device 212 is a flexible and/or inflatable membrane that takes on substantially the shape of a torus when inflated. In the deflated state, the membrane no longer blocks the second opening and the projectiles can be loaded into the firing chamber 208 as illustrated in FIG. 6(*a*). When the retention device 212 is inflated, as illustrated in FIG. 6(*b*), the retention device 212 prevents projectiles from moving through the opening 210. Furthermore, the last projectile 216 in the firing chamber and the retention device 212 substantially seals the second opening 210 of the firing chamber 208 so as to prevent the injected propellant from seeping through the second opening 210 during firing.

Alternatively, the retention device 212 may naturally be in a constricted state so as to block the second opening 210 with or without the help of the projectile 216. In this embodiment, a negative pressure or mechanical/electrical device 220 dilates the retention device 212 from its constricted state to allow for the projectiles to be loaded into the firing chamber. Once the negative pressure or mechanical/electrical device is removed or turned off, then the membrane memory/elasticity of the retention device 212 will return the retention device 212 to the constricted state.

The opening and closing of the retention device 212 may be controlled by the control circuit 204. It will be understood that the retention device 212 can be returned to the inflated/constricted state either automatically after the loading sequence is completed or after the firing sequence has began and the invention is not limited thereto.

As illustrated in FIG. 6(*c*), in response to the trigger being pulled, the control unit 204 directs the propellant injection system to inject propellant into the firing chamber through the inlet 214. According to one embodiment of the invention, the propellant enters the firing chamber 208 through an inlet 214. The inlet is located in front of the last projectile 216 in the firing chamber. When the propellant enters and/or is ignited, the pressure from the propellant forces the projectile 216 against the projectile retention device 212 which helps to substantially seal the second opening of the firing chamber. Once the pressure from the propellant becomes so great, the projectile 215 overcomes the resistance of the projectile retention device 211, and the projectile 215 is expelled out of the firing chamber 208 and through the barrel of the gun as illustrated in FIG. 6(*d*). The retention device 212 then deflates/dilates and the next projectile in the storage magazine is introduced into the firing chamber moving the projectile 216 up against the retention device 211 and the gun is ready to be fired again. Furthermore, the gun may also comprise means for detecting whether the gun is in a proper firing condition. These means may include mechanical sensing means for detecting projectile pressure on a retaining device, e.g. projectile retention device 211, or means for detecting occlusion of a light path (not shown).

According to one embodiment of the invention, the gas or air expelled from the retention device 212 during deflation can be directed through an inlet 217 in the storage magazine 213 to help facilitate the loading of the next projectile into the firing chamber. It will be understood that the inlet can be positioned anywhere in the storage magazine.

Figure 7:
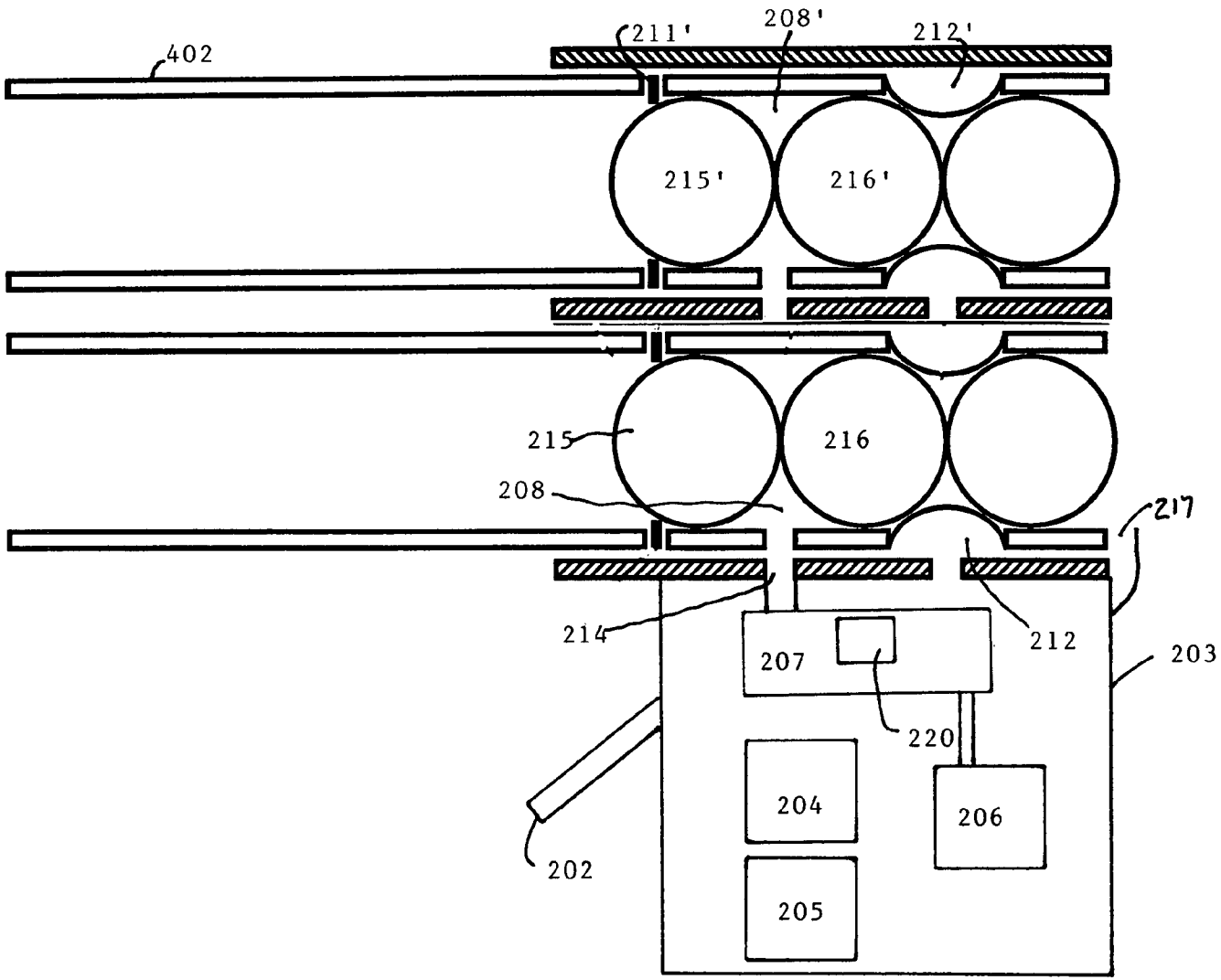
FIG. 7 illustrates a multi-barrel assembly according to one embodiment of the invention.

As illustrated in FIG. 7, the invention can also be applied to weapons which have multiple barrels. While FIG. 7 illustrates 2 barrels, the invention can be applied to any number of barrels. According to the invention, each barrel has the same features as a single barrel assembly namely, its own firing chamber 208, 208', retention device 211, 211', retention device 212, 212', inlet 214, 214' and projectiles 215, 216, 215', 216'. The multi-barrel weapon may have multiple propellant reservoirs, propellant injection devices, and control circuits and electrical supply, but the invention is not limited thereto. Each barrel assembly operates in the same manner described above with reference to FIGS. 6(*a*)-6(*d*).

The invention can be implemented in any suitable form including hardware, software, firmware or any combination of these. The elements and components of an embodiment of the invention may be physically, functionally and logically implemented in any suitable way. Indeed, the functionality may be implemented in a single unit, in a plurality of units or as part of other functional units. As such, the invention may be implemented in a single unit, or may be physically and functionally distributed between different units and processors.

Although the present invention has been described above with reference to (a) specific embodiment(s), it is not intended to be limited to the specific form set forth herein. Rather, the invention is limited only by the accompanying claims and, other embodiments than the specific above are equally possible within the scope of these appended claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A barrel assembly for a device for shooting projectiles, comprising:

a firing chamber with first and second openings; said firing chamber being capable of holding at least two projectiles a first projectile retention device at said second opening of the firing chamber a propellant injection device for injecting propellant into the firing chamber through a third opening, a firing control device for initiating the injection of propellant into the firing chamber, wherein at least one projectile and said projectile retention device substantially seal the second opening of the firing chamber when propellant is introduced and at least one projectile is expelled out of a barrel through the first opening of the firing chamber.

2. The barrel assembly according to claim 1, wherein the first projectile retention device is flexible membrane.

3. The barrel assembly according to claim 2, wherein the flexible membrane is attached radially in the bore of the barrel.

4. The barrel assembly according to claim 2, wherein the flexible membrane is part of the barrel wall in the firing chamber.

5. The barrel assembly according to claim 2, further comprising:

means for inflating the flexible membrane prior to injecting the propellant into the firing chamber.

6. The barrel assembly according to claim 5, wherein the flexible membrane is deflated after at least one projectile has been expelled through the first opening of the firing chamber.

7. The barrel assembly according to claim 6, wherein at least one additional projectile enters the firing chamber from a storage magazine through the second opening when the flexible membrane deflates.

8. The barrel assembly according to claim 7, wherein a gas exiting the deflating flexible membrane is directed through a fourth opening located between projectiles in the storage magazine to further facilitate loading of at least one projectile into the firing chamber.

9. The barrel assembly according to claim 8, wherein projectiles in the storage magazine are biased toward entering the firing chamber.

10. The barrel assembly according to claim 9, wherein the projectiles are biased by a spring.

11. The barrel assembly according to claim 9, wherein the projectiles are biased by gravity.

12. The barrel assembly according to claim 1, further comprising:

a second projectile retention device located at the first opening of the firing chamber for preventing the plurality of projectiles from passing through the first opening until propellant is injected into the firing chamber.

13. The barrel assembly according to claim 12, wherein the second projectile retention device is a flexible membrane having a diameter which is smaller than the diameter of the firing chamber.

14. The barrel assembly according to claim 12, wherein the second projectile retention device is a spring loaded pin or flexible protrusion which protrudes to partially block the first opening.

15. The barrel assembly according to claim 2, wherein at least one projectile and said first projectile retention device in a normal state substantially seals the second opening when propellant is introduced into the firing chamber.

16. The barrel assembly according to claim 15, further comprising:

means for dilating the first projectile retention device to allow for at least one additional projectile in a storage magazine to pass through the second opening into the firing chamber.

17. The barrel assembly according to claim 16, wherein the first projectile retention device returns to the normal state after the at least one projectile has been loaded into the firing chamber.

18. The barrel assembly according to claim 1, wherein the firing control device is a mechanical trigger.

19. The barrel assembly according to claim 1, wherein the firing control device is an electrical firing mechanism.

20. The barrel assembly according to claim 1, wherein the propellant injection device comprises;

a pressurized propellant reservoir, and a valve for introducing the pressurized propellant into the firing chamber.

21. The barrel assembly according to claim 20, wherein the propellant is ignitable.

22. The barrel assembly according to claim 21, wherein the ignitable propellant is ignited by a spark ignition device.

23. The barrel assembly according to claim 1, wherein said device is one of the group of: weapon, weapon array, firearm, gun, pneumatic gun, BB gun, paintball gun.

24. The barrel assembly according to claim 1, wherein said device has a plurality of barrels and each barrel has a separate firing chamber and first projectile retention device.

25. The barrel assembly according to claim 20, wherein the propellant is air or a gas.

26. The barrel assembly according to claim 1, wherein said third opening is located in between two of the projectiles.

* * * * *